United States Patent [19]

Schnell et al.

[11] 3,930,557

[45] Jan. 6, 1976

[54] NOISE REDUCTION KIT FOR CAN CLOSING MACHINE

[75] Inventors: Albert C. Schnell, Hickory Hills; Craig W. Arends, Chicago Ridge; Dean N. Zwikel, Chicago, all of Ill.

[73] Assignee: Continental Can Company, Inc., New York, N.Y.

[22] Filed: Nov. 6, 1974

[21] Appl. No.: 521,268

Related U.S. Application Data

[62] Division of Ser. No. 398,263, Sept. 17, 1973, Pat. No. 3,851,725.

[52] U.S. Cl. ..... 181/33 K; 181/33 A; 113/114 BG; 113/30

[51] Int. Cl. ..... E04b 1/99

[58] Field of Search ..... 181/33; 113/30, 114; 253/266

[56] References Cited

UNITED STATES PATENTS

| | | | |
|---|---|---|---|
| 2,696,285 | 12/1954 | Zenlea | 113/114 R |
| 2,952,233 | 9/1960 | Gardner | 113/114 R |
| 3,556,031 | 1/1971 | Frankenberg | 113/30 |
| 3,583,347 | 6/1971 | Whitten | 113/30 |

*Primary Examiner*—L. T. Hix
*Assistant Examiner*—Vit N. Miska
*Attorney, Agent, or Firm*—Lockwood, Dewey, Zickert & Alex

[57] ABSTRACT

The purpose of the machine noise reduction kit is to provide a noise attenuating apparatus for closing machines used for seaming end covers on metal, cardboard, paper or seamable type cans or containers. The reason for developing the noise reduction kit was to protect the machine operator from excessive noise levels as defined by the Occupational Safety and Health Administration better known as OSHA. The kit has been detail designed, fabricated and installed on a can closing machine with a reduction in noise at the operator's position from 98 dBA to 86 dBA.

In addition to being a noise attenuating device, the use of the kit eliminates the splashing and drainage of spilled product onto the floor around the machine, thereby improving sanitary conditions in the plants.

3 Claims, 10 Drawing Figures

NOISE REDUCTION KIT FOR CAN CLOSING MACHINE

This application is a divisional of our copending application Ser. No. 398,263, filed Sept. 17, 1973, now U.S. Pat. No. 3,851,725.

BACKGROUND OF THE INVENTION

In the past closing machines were relatively slow (200 units per minute) and therefore noise levels at the operator's position were generally below 90 dBA. Due to advances in technology and the demands for higher production speeds, new closing machines are currently operating at 1200 units per minute with near future projected goals up to 2000 units per minute. With these increases in production speed, operators are exposed to noise levels approaching 102 dBA or more. According to present guidelines established by the Occupational Safety and Health Administration, the operator cannot legally operate machines at this noise level for more than 1½ hours of an eight hour working day. Investigations to locate noise reduction kits for closing machines have failed to turn up applicable solutions.

SUMMARY OF THE INVENTION

The invention consists of three primary components:

1. Lower base enclosure.
2. Center walls and doors enclosure.
3. Upper electric drive motor enclosure.

The lower base enclosure 1 is secured to the underside of the lower frame of the machine. The center walls and doors enclosure 2 is secured to the side walls of the upper frame 3 of the machine as seen in FIG. 2. The center enclosure 2 extends between a seal built into the lower enclosure 1 so that the two enclosures 1 and 2 can move in a telescoping fashion when the upper frame is raised or lowered to accommodate changes in can heights. The lower enclosure 1 overlaps the center enclosure 2 by about 4 inches. The telescoping effect allows an infinite number of can height settings between 3⅜ inches and 6¼ inches. This also eliminates breaking the seal between the lower base enclosure and the center enclosure while making height adjustments. The benefit of this telescoping seal system is that it reduces the chance of seal damage and it eliminates the chance of installing the seal incorrectly after each adjustment. Thus, the seal system improves the life of the noise kit by minimizing the growth of noise leaks over the years of operation. Past experience has shown that the effectiveness of noise enclosure is directly related to the durability of seals. The upper electric drive motor enclosure 3 is independent of the lower base enclosure and the center enclosure to the extent that it is not attached to them. The upper electric drive motor enclosure is required to achieve the 84 dBA level; without it the noise level would be 86 dBA at the operator's station.

BRIEF DESCRIPTION OF THE DRAWINGS

Further details of the invention will appear from the following description of several embodiments of the invention with reference to the accompanying drawings in which.

DESCRIPTION OF THE PREFERRED EMBODIMENT

Figure 1:
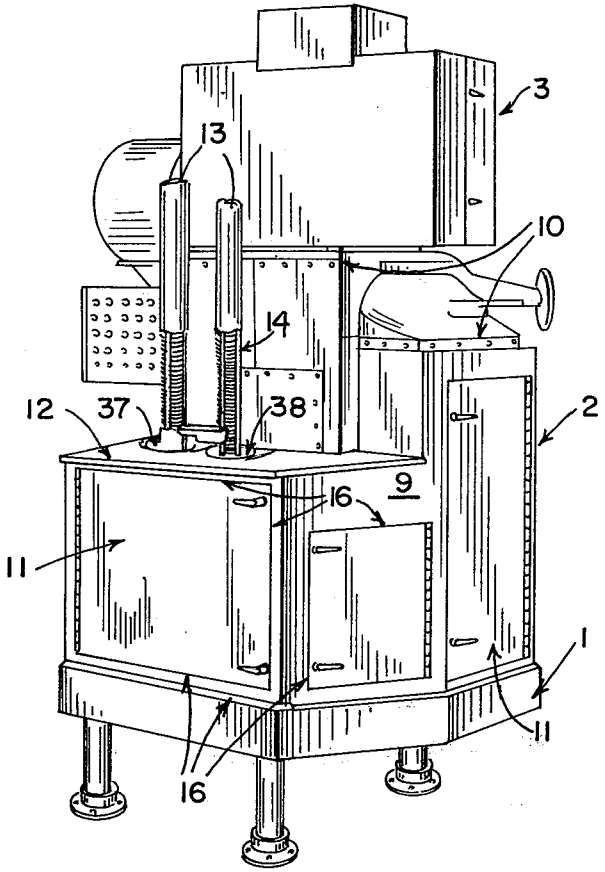
FIG. 1 shows a closing machine with the noise reduction kit installed.

As seen in FIG. 1, the lower base enclosure 1 approximates the general configuration of the lower machine frame. The lower machine frame itself stands on three legs about 18 inches above the floor (FIG. 1). Frame 4 (FIG. 3) is somewhat like an inverted cup inside of which is a series of gear systems 5 transmitting power to various drive shafts 6 extending through its top surface. Originally the bottom area of the frame was completely open exposing the gears 7, 8 and thus allowing noise generated by the gears to escape from under the machine.

Figure 2:
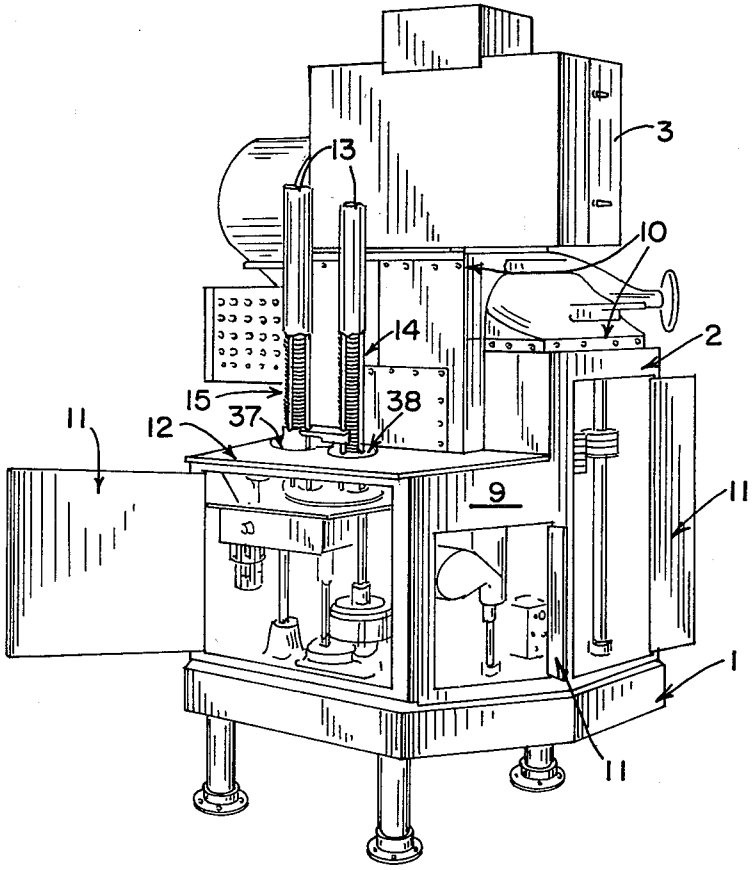
FIG. 2 shows a closing machine with the noise reduction kit installed and with the doors and panels in opened position.

As seen in FIG. 2, the center side walls 9 and door portion 11 of the center enclosure 2 have the same lower shape as lower enclosure 1. A table type ledge 12 is located at the operator's side of the machine so that the original feed stacks 14, 15 for end units 13 can still be used to feed the machine. The center enclosure 2 is directly fastened to the side walls of the top machine frame 10 (FIGS. 1 and 2). The table ledge 12 has frame supports which mount on the machine feed table (not shown) which in turn is an integral part of the top machine frame.

The side walls 9 are made up of 16 gauge sheet metal. For ease of cleaning, a material such as stainless steel may be used as the sheet metal throughout. The inside of the enclosures 1 and 2 is bare sheet metal and is not lined with a noise absorbing material. Therefore, due to noise build-up inside, the seams 16 between doors 11 and walls 9 and between enclosures 1 and 2 must have effective seals to stop noise leaks. The reason that no absorbing materials can be used inside is because such materials are porous in nature and would be a breeding environment for bacteria due to the constant spillage of liquid inside of the machine.

Large access doors 11 are placed on four lateral walls of the enclosure. These doors are made of 16 gauge sheet metal. They are provided to give maximum access to the inside of the machine in order that operators or maintenance personnel can perform required work on the machine with speed and efficiency. If these doors were not large enough, panels would have to be removed each time access is required to enclosed parts of the machine. It has been learned that frequent removal of noise enclosure parts accelerates the deterioration of the enclosure's effectiveness. This is a result of improper reassembly, wearing out of fasteners and seals and the loss of parts which cause noise leaks. Therefore, the provision of large access doors saves production time and increases the useful life of the enclosure by minimizing maintenance work on the enclosure itself.

The large access side doors 11 were designed to prevent liquid leaks as well as noise leaks.

The top of the table type ledge 12 (FIG. 2) can be removed by flipping four suitcase type latches. Quick removal of this cover is required because of frequent adjustments to the cover feeding system.

Figure 3:
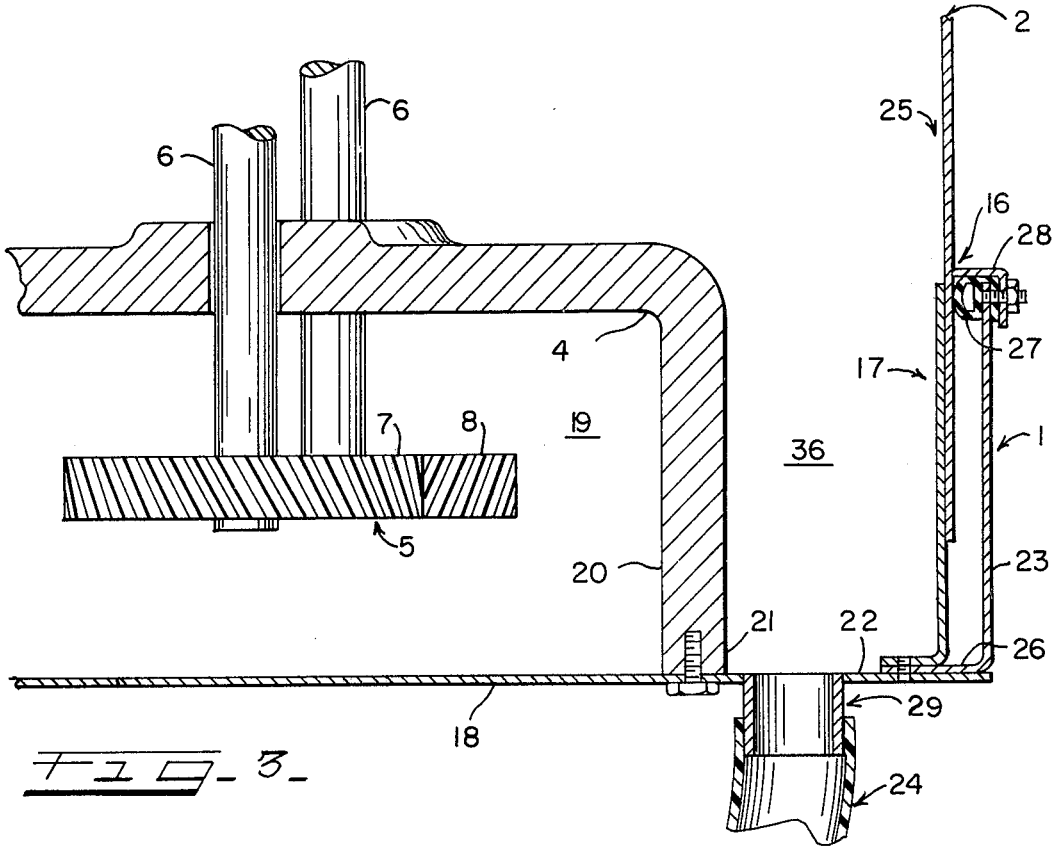
FIG. 3 shows a cross-section view of the telescoping action between the lower base enclosure and the center wall enclosure.

The underside of the machine frame is closed off by two steel plates 18 mounted edge to edge, see FIG. 3. These plates 18 enclose frame 4 trapping the gear noise inside the frame compartment 19. Plates 18 are fastened to the bottom edge of the frame side walls 20 and a neoprene rubber like material is used to provide a watertight seal 21 between the frame 20 and plate 18. Seal 21 also acts to reduce the transmission of vibration energy from the machine frame 4 into the relatively flexible plate 18. Plate 18 extends past the outer edge of the frame to form the lower surface of enclosure 1.

Fasteneed to the top surface 22 of steel plate 18 (FIG. 3) is the outer side wall 23 and pressure plates 17 which form the guide system for the telescoping walls 25 of the center enclosure 2. A rubber-like gasket 26 is used to form a watertight seal between surface 22 and the base of side wall 23. The outer edge side wall 23 is continuous and extends around the entire machine. Each pressure plate 17 is two inches wide and one is located every seven inches behind side wall 23. Plate 17 is welded to the base of wall 23 to maintain a set distance for sealing purposes between the continuous outer side wall 23 and the series of pressure plates 17. Mounted on the top of side wall 23 is an extruded elongated resilient seal 27 with a metal angle protection strip 28. Seal 27 may also be resilient material such as sponge or foam. Angle strip 28 is used as a spacer to prevent excessive wear of the seal 27 and to prevent seal 27 from slipping out of position when enclosure 2 is withdrawn. Pressure plate 17 is designed to exert sufficient force on the enclosure wall 25 to ensure proper contact with seal 27. Connected to drain port 29 is a pipe or base used to remove liquids from enclosure 1. These liquids may come from material in the cans which drain from the machine lower frame 4 and from the walls of enclosure 2.

Lower enclosure 1 serves the following functions:

First, the lower enclosing plate 18 traps gear noise inside the lower machine frame cavity.

Second, the side wall 23 and lower plate 18 form the outer walls of the lower enclosure 1 which with enclosure 2 traps noise of end units and cans inside the machine.

Third, the seal system using items 23, 17, 27 and 28 forms a noise seal which allows enclosure 2 to telescope up and down without disturbing the seal.

Fourth, the lower enclosure 1 not only serves as part of the total noise enclosure but also catches spilled liquids which drain from the machine frame itself and from the walls 25 of enclosure 2.

Fifth, the lower enclosure 1 enables the collection of all spilled liquids to be drained through port 29 into pipe 24 directly to a central drain. This eliminates drainage directly onto the floor around the machine and therefore improves sanitary conditions and provides safer working conditions for operators and maintainers.

Figure 4:
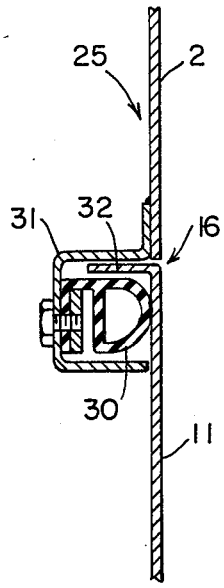
FIG. 4 shows a cross-section view of the seals used on the side and top edges of the hinged doors.
Figure 5:
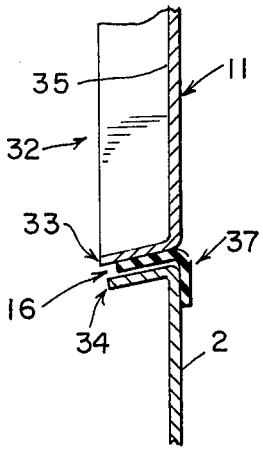
FIG. 5 shows a cross-section view of the seals used on the bottom edge of the hinged doors.

Seals for the two vertical and the top seams 16 of the side doors 11 are shown in FIGS. 4 and 5. The seal 30 (FIG. 4) is mounted in an elongated channel 31 attached to the walls 25 of the center enclosure 2. Channel 31 acts as a shield to prevent splashing of liquid directly against the seal 30 to reduce the chance of liquid leaks. The seal 30 and channel 31 also provide a labyrinth of passages that noise must travel through in order to leak out of the door seams 16. The labyrinth effect increases the noise reduction of the door seals. A ledge 32 extends around the top and side edge of each door 11 to stiffen the door and to increase the labyrinth effect formed with seal 30 and channel 31 and to force liquids seeping by seal 30 to drain down door 11.

The lower edge of the door 11 has a lip 33, shown in FIG. 5, that extends over the lower edge sill 34 of the door entrance. This ensures that liquids running down the inner door surface 35 will drop off lip 33 and into the basin 36 (FIG. 3) formed by enclosure 1. An elastomeric strip 37 is fastened to the bottom edge of lip 33 to seal against noise and liquid leaks through seam 16 (FIG 5).

The center enclosure 2 has four passages. Two passages 38 (FIGS. 1 and 2) are used for feeding end units or container tops 13 into the enclosure. A third passage 39 (FIG. 8) is for bringing unseamed or topless containers into the enclosure. The fourth passage 40 (FIG. 8) is for bringing seamed containers with tops fastened in place out of the enclosure.

Figure 6:
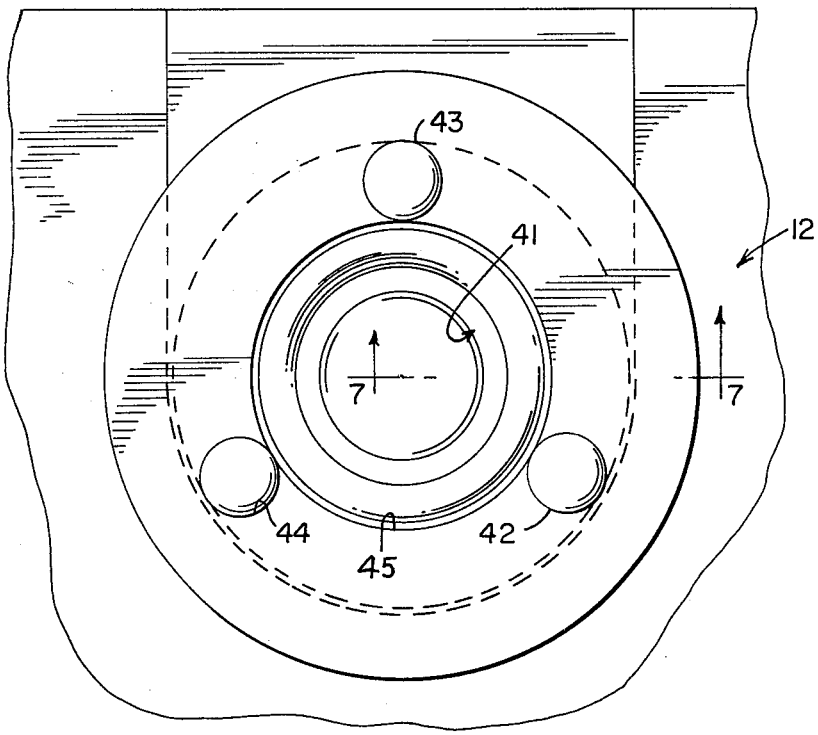
FIG. 6 shows a top view of the end unit tunnel and guides.

The passages 38 for feeding end units 13 into the enclosure are specially designed noise trap and friction sealing tunnels 41 as shown in FIG. 6. The purpose of tunnel 41 is to provide a seal against noise leakage between stacks 14, 15 of end units 13 which are fed into the enclosure 2 through the table ledge panel 12. The second purpose is to stop the bounce of an entire stack 14, 15 of end units 13 which results each time an end unit is pulled from the bottom of end feed stack 14, 15. The bouncing can be a significant noise source if a large number of end units 13 is not kept in the end feed stacks 14 and 15. Each end unit stack 14, 15 is held in place by three guides 42–44 forming a conveyor frame.

Figure 7:
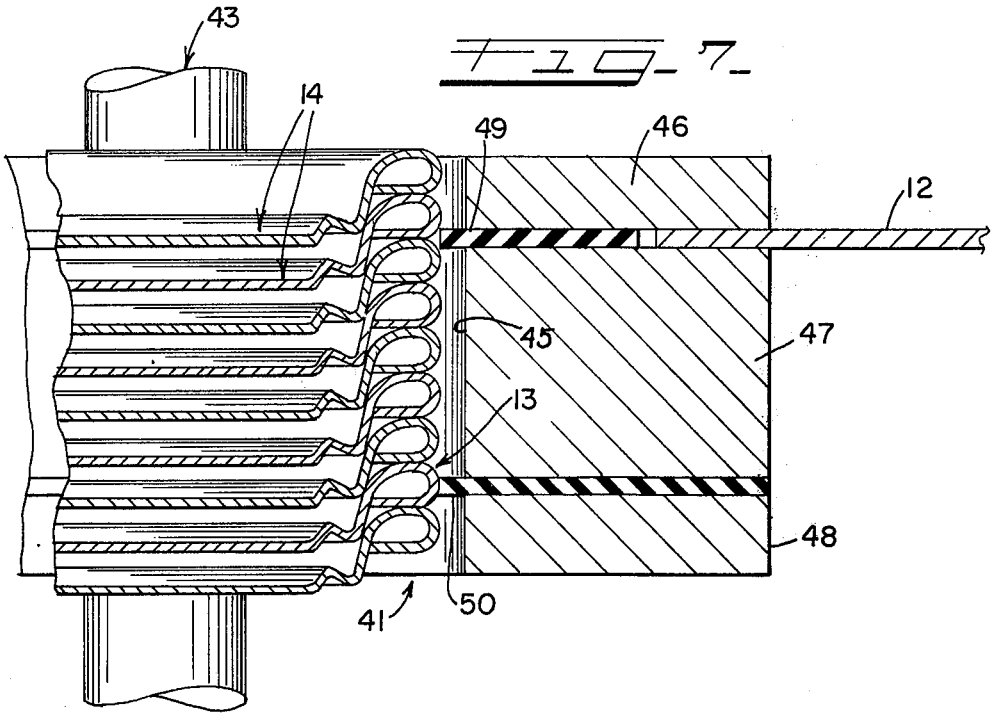
FIG. 7 shows a cross-section view 7—7 of a part of the end unit tunnel and tunnel seals of FIG. 6.

The friction sealing tunnel 41 is better shown in FIG. 7. The tunnel sealing function operates to stop noise leaks from the enclosure in two ways. First, a seal between the table top 12 and the tunnel circumference 45 is achieved by sandwiching the table top 12 between the annular rings 46–48. Second, the seal between the end units 13 and tunnel 41 is achieved by passing the stack 14 of end units through a series of two elastomeric friction annular ring seals 49 and 50. The spacing of the two seals is set such that one end unit is always in contact with either seal while the remaining seal has just released an end unit. Ring 47 is about an integral number of end units plus one-half thick. The same seal effect could be achieved by using just one seal. The seal in this case would have to be twice the thickness of one end; in this way one end unit is always in the seal passage. The circular hole in the seal is cut to be the same or smaller diameter as the end unit. This allows zero clearance, therefore eliminating a path for noise to leak out when an end unit is in the seal. Since one end unit is always in contact with a seal, there is never a direct path that will allow noise to leak out of the enclosure through tunnel 41.

The reason for using two elastomeric seals 49 and 50 instead of one thick seal is to eliminate bounce of the stack of end units 14 above the tunnel 41. Cover feed screws (not shown) which remove one end unit 13 from the bottom of the stack 14 of units has a 0.040 inch separation lip that causes the end unit above the unit being fed to be lifted 0.040 inches. Since all the end units in the stack are in contact, the entire stack of units is lifted 0.040 inches. Because the screw is pulling 600 end units per minute from the bottom of the stack 41, stack 14 in turn bounces 600 times per minute or tries to bounce this fast. As a result, sufficient load or force must be maintained on top of the stack to keep end units on top of the stack from separating and rattling as they bounce. This bounce can result in a noise source as high as 90 dBA. By passing the end units 13 through seals 49 and 50, sufficient drag is imposed to induce 0.040 inch clearance between the end units trapped between seals 49 and 50. This causes the end units above tunnel 41 not to bounce while the covers below tunnel 41 still bounce but do no harm since the noise is trapped inside the tunnel and enclosure 2.

Figure 8:
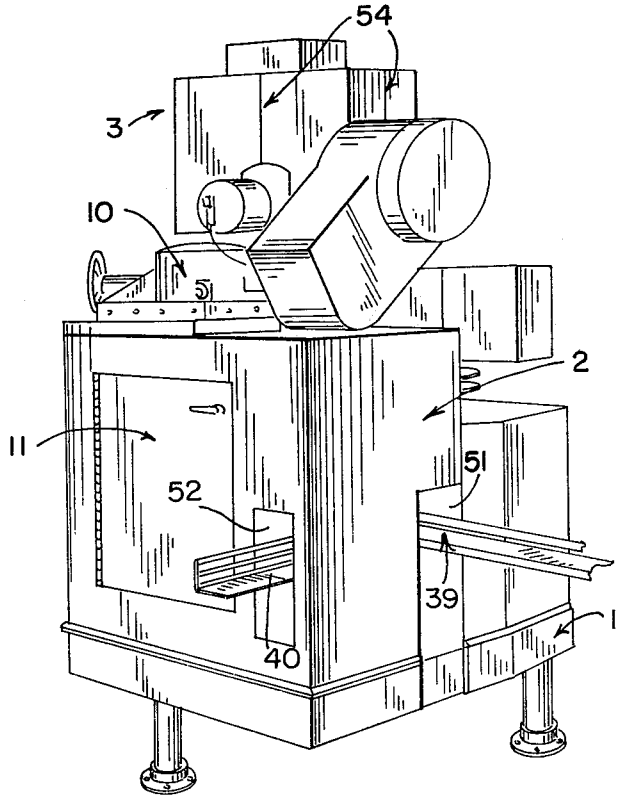
FIG. 8 shows a view of the closing machine having a noise reduction kit installed and showing container passage openings.

The passageway for bringing unseamed or topless containers into the enclosure is a tunnel 51 as shown in FIG. 8. Tunnel 51 extends one foot inside the machine from the outer wall up to the point where the covers are placed on top of the containers. Tunnel 51 acts as a baffle or shield to reflect noise back into enclosure 2 and limits the area that noise can enter and thus reduces noise that can escape out of the enclosure.

The passage for removing containers from the enclosure is an opening 52 cut in the wall of enclosure 2 as shown in FIG. 8. There is no tunnel required because the amount of noise that radiates out does not increase the noise levels significantly. This is because the primary noise source is on the opposite side of the machine at the operator's station. Thus, the passage is shielded or baffled off by the presence of the machinery inside the enclosure.

The center enclosure 2 serves the following functions:

First, the side walls, doors and passages, along with the lower enclosure 1, form a noise-tight enclosure around the primary noise sources of a closing machine to give a significant noise reduction of 12 dBA at the operator's position.

Second, lower enclosure 1, along with enclosure 2, serves as a liquid-tight enclosure of the machine to prevent drainage of spilled liquids onto the floor, thus improving sanitary conditions as well as safety conditions.

Third, the provision for large access doors saves considerable time for maintenance and does not reduce production. Large access doors also improve the life of the noise enclosure by reducing the development of noise leaks which are known to form with panels when frequently removed.

Fourth, unique shields 31, 33 for access doors prevent direct contact of splashed liquid on seals and creates a labyrinth effect to improve the noise reduction of the seals.

Fifth, the friction sealing tunnel 41 is a multipurpose noise reduction means in that it:

a. Seals against noise leaks between the enclosure and tunnel.

b. Seals against noise leaks between the tunnel and end units.

c. Eliminates noise source of the stack of covers bouncing outside of the enclosure.

This apparatus may be used in a variety of infeed situations.

Figure 9:
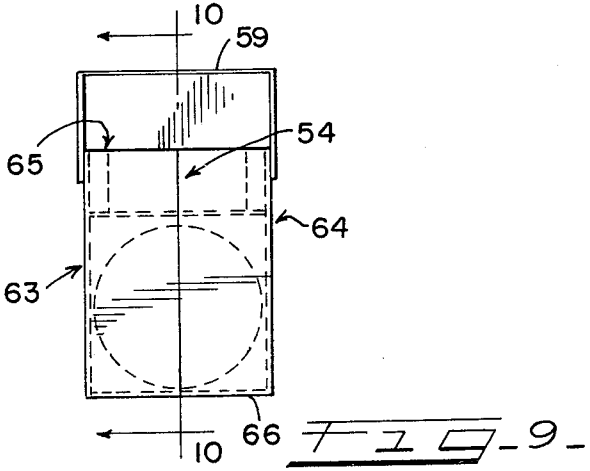
FIG. 9 shows an end view of the electric drive motor noise enclosure.

The main electric drive motor 53 mounted on top of the top frame is enclosed in a specially designed noise enclosure 3 as seen in FIG. 1. Enclosure 3 is made of four pieces as shown by parting lines 54. The enclosure can be removed from the motor 53 in a matter of seconds by releasing six suitcase latches. The enclosure has special passages 55, 56 to allow ambient air to be supplied to the motor coolant fan and discharges through separate discharge passages 57, 58. The end view of FIG. 9 shows the motor as located in the bottom of the enclosure 3 and shows the air ducts 55 above the enclosure.

Figure 10:
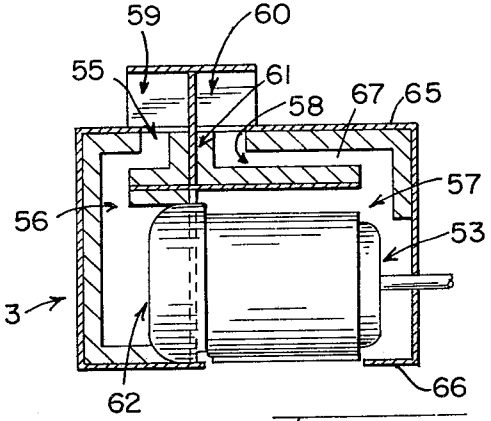
FIG. 10 shows a cross-section view taken along the line 10—10 of FIG. 9.

A cross-section view of the motor 53 and enclosure 3 is shown in FIG. 10. The enclosure is simple and inexpensive. The coolant fan (not shown) is built into the self-cooling electric motor as a standard part of the motor. The enclosure is divided into two compartments by a partition 61 that is sealed around the outer circumference of the fan housing 62 and extends to the sides 63, 64; top 65 and bottom 66 of the enclosure. This partition prevents air that has passed through the fan and heated up from recirculating back into the cooling compartment 56. The inside areas of the passageways 55, 56, 57 and 58 are lined with one-inch thick sound absorbing polyurethane foam. The foam absorbs noise created by the fan and from the electric motor. A second partition 67 extends beside the motor almost to the ends of the enclosure. The passageways 55 and 58 were made as long as possible so that a maximum amount of noise could be absorbed before the noise exists from the intake and exhaust ducts 59, 60. To make these passages a maximum length for noise absorption requires that both ports be next to each other. To prevent warm exhaust air from passage 58 from being drawn into the coolant air intake passage 55, the partition 61 was extended from the top of the enclosure to form ducts 59 and 60.

The upper electric drive motor enclosure serves the following functions:

First, the enclosure gives a 2dBA noise reduction from 86 to 84 dBA for the closing machine.

Second, the enclosure design is simple and uses the electric motor coolant fan to ventilate the enclosure.

Third, the enclosure can be disassembled in seconds for inspection or maintenance work.

Fourth, the enclosure is a unique noise reduction design for self-cooling electric motors or for any type of motor or device which can force draw air for use in an energy conversion device such as to burn with fuel and then exhaust combustion products or heated air away from the energy conversion device. This design can be used to enclose any type motor as long as the air supply source is kept separate from the exhaust or heated air and the primary engine is used to draw air in and force it out through noise lined passages.

The total enclosure has at least the following advantages: sound abatement, liquid waste collection and elimination, long-wearing noise abatement seals, easy accessibility to original or enclosed machine and provides sound abatement without use of noise absorbing materials inside which could not meet sanitary requirements.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

The invention is hereby claimed as follows:

1. A soundproof enclosure having at least one noise trap and vibration eliminator tunnel for feeding can end units or similar disc-shaped objects into the interior of the enclosure and also incorporating a noise seal between the tunnel and the enclosure wall comprising:

a first rigid annular support ring mounted on an enclosure for said end units and having an opening in said ring such that said end units pass freely through a center hole of said ring;

a first flexible and resilient annular ring seal mounted underneath said first rigid ring and having an outer size the same as said first rigid ring and an inner size slightly smaller than said first rigid ring and equal or smaller in size to said end units such that said first flexible ring seal imposes a retarding sliding frictional force on the periphery of each end unit that passes through said ring seal and at the same time creates an airtight seal about the periphery of the end unit as said end unit travels past said first flexible ring seal;

a second rigid annular ring having the same inner and outer size as said first rigid ring and mounted on and under said enclosure and forming with said first rigid annular support and said enclosure an annular hollow for said first flexible annular ring seal between the bottom surface of said first rigid ring and the top surface of said second rigid ring and acting as a spacer for a second flexible and resilient annular ring seal which is mounted on the bottom surface of said second rigid ring, said second rigid annular ring having a thickness equal to about several thicknesses of the end unit plus one-half thickness whereby when an end unit is in engagement with said first ring seal two or more said end units lie within the thickness of said second rigid ring and said second flexible ring seal is not in engagement with said periphery of said end unit lying on top of said end units in said length of said second rigid ring;

a second flexible and resilient annular ring seal mounted on the bottom of said second rigid annular ring; and a third rigid annular ring having the same inner and outer size as said first and second rigid rings and mounted on a conveyor frame and sandwiching said second ring seal between the bottom surface of said second rigid ring and the top surface of said third rigid ring whereby said can end units are prevented from bouncing and noise from within said enclosure does not leak out.

2. A soundproof enclosure having at least one noise trap and vibration eliminator tunnel for feeding end units or similar disc-shaped objects into the interior of said enclosure as set forth in claim 1 in which said second annular ring comprises:

an annular ring having a thickness equal to an integral number of end unit plus one-half an end unit and an interior diameter of slightly greater than the diameter of said can end units.

3. A soundproof enclosure having at least one noise trap and vibration eliminator tunnel for feeding can end units or similar disc-shaped objects into the interior of the enclosure and which includes a noise seal between the tunnel and the enclosure wall which comprises an opening in the enclosure wall sized such that said end units pass freely therethrough, first and second resilient annular ring seals mounted at the opening, each ring seal having an opening aligning with the enclosure wall opening but sized smaller and equal to or smaller than said end units such that a retarding frictional force is applied to the periphery of each end unit as it passes through the openings of the ring seals to create an airtight seal about the periphery of each end unit and said ring seals being spaced apart such that at least one end unit in a stack placed in the enclosure wall opening tightly seals at its periphery with one of the ring seals whereby said can end units are prevented from bouncing and noise from within said enclosure does not leak out.

* * * * *